US010943530B1

(12) United States Patent
Yeh

(10) Patent No.: US 10,943,530 B1
(45) Date of Patent: Mar. 9, 2021

(54) MURA COMPENSATION METHOD AND APPARATUS FOR OLED DISPLAY AND ELECTRONIC DEVICE

(71) Applicant: HIMAX TECHNOLOGIES LIMITED, Tainan (TW)

(72) Inventor: Ying-Han Yeh, Tainan (TW)

(73) Assignee: HIMAX TECHNOLOGIES LIMITED, Tainan (TW)

( * ) Notice: Subject to any disclaimer, the term of this patent is extended or adjusted under 35 U.S.C. 154(b) by 0 days.

(21) Appl. No.: 16/799,798

(22) Filed: Feb. 24, 2020

(51) Int. Cl.
*G09G 3/3208* (2016.01)

(52) U.S. Cl.
CPC ... *G09G 3/3208* (2013.01); *G09G 2320/0233* (2013.01); *G09G 2320/0276* (2013.01); *G09G 2320/0285* (2013.01); *G09G 2320/045* (2013.01); *G09G 2320/0626* (2013.01); *G09G 2360/16* (2013.01)

(58) Field of Classification Search
CPC ..... G09G 3/3208; G09G 2320/0233; G09G 2320/0276; G09G 2320/0285; G09G 2320/045; G09G 2320/0626; G09G 2320/16
See application file for complete search history.

(56) References Cited

U.S. PATENT DOCUMENTS 9,898,998 B2 * 2/2018 Lee ..... G09G 5/02
10,733,932 B2 * 8/2020 Pyo ..... G09G 3/2003
10,741,116 B2 * 8/2020 Ding ..... G09G 5/02
2002/0130830 A1 * 9/2002 Park ..... G09G 3/3406 345/99
2006/0164355 A1 * 7/2006 Kim ..... G09G 3/3648 345/89
2007/0262947 A1 * 11/2007 Wang ..... G09G 3/3426 345/102
2008/0036703 A1 * 2/2008 Wang ..... G09G 3/006 345/76
2009/0140665 A1 * 6/2009 Park ..... H05B 45/44 315/291
2016/0358526 A1 * 12/2016 Wang ..... G09G 3/20
2020/0066207 A1 * 2/2020 Gu ..... G09G 3/3275
2020/0160791 A1 * 5/2020 Chung ..... G09G 3/3275
2020/0219433 A1 * 7/2020 Yim ..... G09G 3/2044

* cited by examiner

*Primary Examiner* — Sejoon Ahn

(74) *Attorney, Agent, or Firm* — CKC & Partners Co.. LLC

(57) ABSTRACT

A mura compensation apparatus for an organic light emitting diode (OLED) display includes a calculator and a mura compensator. The calculator is configured to calculate a non-maximum-luminance demura offset value of a pixel of the OLED display for a determined gray level on the basis of a gamma value, a maximum-luminance demura offset value of the pixel of the OLED display for a relocated gray level and a non-maximum luminance value of the OLED display. The mura compensator is configured to perform mura compensation on the pixel of the OLED display by the non-maximum-luminance demura offset value for the determined gray level.

17 Claims, 4 Drawing Sheets

MURA COMPENSATION METHOD AND APPARATUS FOR OLED DISPLAY AND ELECTRONIC DEVICE

BACKGROUND

Field of the Invention

The invention relates to mura compensation, and more particularly to a mura compensation method and a mura compensation apparatus for an organic light emitting diode (OLED) display and an electronic device.

Description of Related Art

Mura phenomenon is a major display quality issue for an organic light emitting diode (OLED) display, which is mainly caused by luminance non-uniformity in the display area. Therefore, mura compensation is usually performed before shipping. For mura compensation of a fabricated OLED display, demura tables corresponding to various gray levels are created by analyzing images of a fabricated OLED display, and then these demura tables are used to adjust the gray level of each pixel. Conventionally, the demura tables are created only for the maximum luminance of the OLED display and are usually stored in a storage medium with a limited storing space. If mura compensation is intended to be performed for various luminance settings of the OLED display, demura tables for non-maximum luminance settings have to be created, and an extra storing space is needed to store the increased demura tables, resulting in a higher storage cost.

SUMMARY

In the invention, for mura compensation of an OLED display, non-maximum-luminance demura offset values corresponding to a non-maximum luminance value of the OLED display can be determined from maximum-luminance demura offset values corresponding to the maximum luminance value of the OLED display, and thus a non-maximum-luminance demura table with these non-maximum-luminance demura offset values is not required to be created and stored in a storage medium. As such, the demura table cost for mura compensation for various luminance settings is significantly reduced.

One aspect of the invention directs to a mura compensation apparatus for an organic light emitting diode (OLED) display. The mura compensation apparatus includes a calculator and a mura compensator. The calculator is configured to calculate a non-maximum-luminance demura offset value of a pixel of the OLED display for a determined gray level on the basis of a gamma value, a maximum-luminance demura offset value of the pixel of the OLED display for a relocated gray level and a non-maximum luminance value of the OLED display. The mura compensator is configured to perform mura compensation on the pixel of the OLED display by the non-maximum-luminance demura offset value for the determined gray level.

In accordance with one or more embodiments of the invention, the calculator includes an offset relocator and an offset scalar. The offset relocator is configured to calculate the relocated gray level on the basis of the gamma value, the determined gray level, the non-maximum luminance value and a maximum luminance value of the OLED display. The offset scalar is configured to perform a scalar operation on the maximum-luminance demura offset value for the relocated gray level to obtain the non-maximum-luminance demura offset value for the determined gray level.

In accordance with one or more embodiments of the invention, the gamma value is in a range from 1.8 to 2.4.

In accordance with one or more embodiments of the invention, the mura compensation apparatus further includes a camera and a processor. The camera is configured to capture an image of the OLED display operated in a maximum luminance value. The processor is configured to create a demura table with the maximum-luminance demura offset value for the determined gray level from the captured image.

In accordance with one or more embodiments of the invention, the non-maximum luminance value is substantially a half of a maximum luminance value of the OLED display.

In accordance with one or more embodiments of the invention, the mura compensation apparatus further includes a storage medium that is configured to store a demura table with the maximum-luminance demura offset value for the determined gray level.

In accordance with one or more embodiments of the invention, the maximum-luminance demura offset value is dependent on a position of the pixel in the OLED display.

Another aspect of the invention directs to a mura compensation method for an OLED display, the mura compensation method includes: calculating a non-maximum-luminance demura offset value of a pixel of the OLED display for a determined gray level on the basis of a gamma value, a maximum-luminance demura offset value of the pixel of the OLED display for a relocated gray level and a non-maximum luminance value of the OLED display; and performing mura compensation on the pixel of the OLED display by the non-maximum-luminance demura offset value for the determined gray level.

In accordance with one or more embodiments of the invention, obtaining the non-maximum-luminance demura offset value includes: calculating the relocated gray level on the basis of the gamma value, the determined gray level, the non-maximum luminance value and a maximum luminance value of the OLED display; and performing a scalar operation on the maximum-luminance demura offset value for the relocated gray level to obtain the non-maximum-luminance demura offset value for the determined gray level.

In accordance with one or more embodiments of the invention, the gamma value is in a range from 1.8 to 2.4.

In accordance with one or more embodiments of the invention, the mura compensation method further includes: capturing an image of the OLED display operated in a maximum luminance value; and creating a demura table with the maximum-luminance demura offset value for the determined gray level from the captured image.

In accordance with one or more embodiments of the invention, the non-maximum luminance value is substantially a half of a maximum luminance value of the OLED display.

In accordance with one or more embodiments of the invention, the maximum-luminance demura offset value is dependent on a position of the pixel in the OLED display.

A further aspect of the invention directs to an electronic device. The electronic device includes an OLED panel and a mura compensation apparatus. The mura compensation apparatus includes a calculator and a mura compensator. The calculator is configured to calculate a non-maximum-luminance demura offset value of a pixel of the OLED panel for a determined gray level on the basis of a gamma value, a maximum-luminance demura offset value of the pixel of the OLED panel for a relocated gray level and a non-maximum luminance value of the OLED panel. The mura compensator is configured to perform mura compensation on the pixel of the OLED panel by the non-maximum-luminance demura offset value for the determined gray level.

In accordance with one or more embodiments of the invention, the calculator includes an offset relocator and an offset scalar. The offset relocator is configured to calculate the relocated gray level on the basis of the gamma value, the determined gray level, the non-maximum luminance value and a maximum luminance value of the OLED panel. The offset scalar is configured to perform a scalar operation on the maximum-luminance demura offset value for the relocated gray level to obtain the non-maximum-luminance demura offset value for the determined gray level.

In accordance with one or more embodiments of the invention, the gamma value is in a range from 1.8 to 2.4.

In accordance with one or more embodiments of the invention, the non-maximum luminance value is substantially a half of a maximum luminance value of the OLED panel.

In accordance with one or more embodiments of the invention, the electronic device further includes a storage medium that is configured to store a demura table with the maximum-luminance demura offset value for the determined gray level.

In accordance with one or more embodiments of the invention, the maximum-luminance demura offset value is dependent on a position of the pixel in the OLED panel.

In accordance with one or more embodiments of the invention, the mura compensation apparatus communicates with the OLED panel through a display serial interface (DSI).

BRIEF DESCRIPTION OF THE DRAWINGS

The foregoing aspects and many of the accompanying advantages of this invention will become more readily appreciated as the same becomes better understood by reference to the following detailed description, when taken in conjunction with the accompanying drawings.

DETAILED DESCRIPTION

Figure 1:
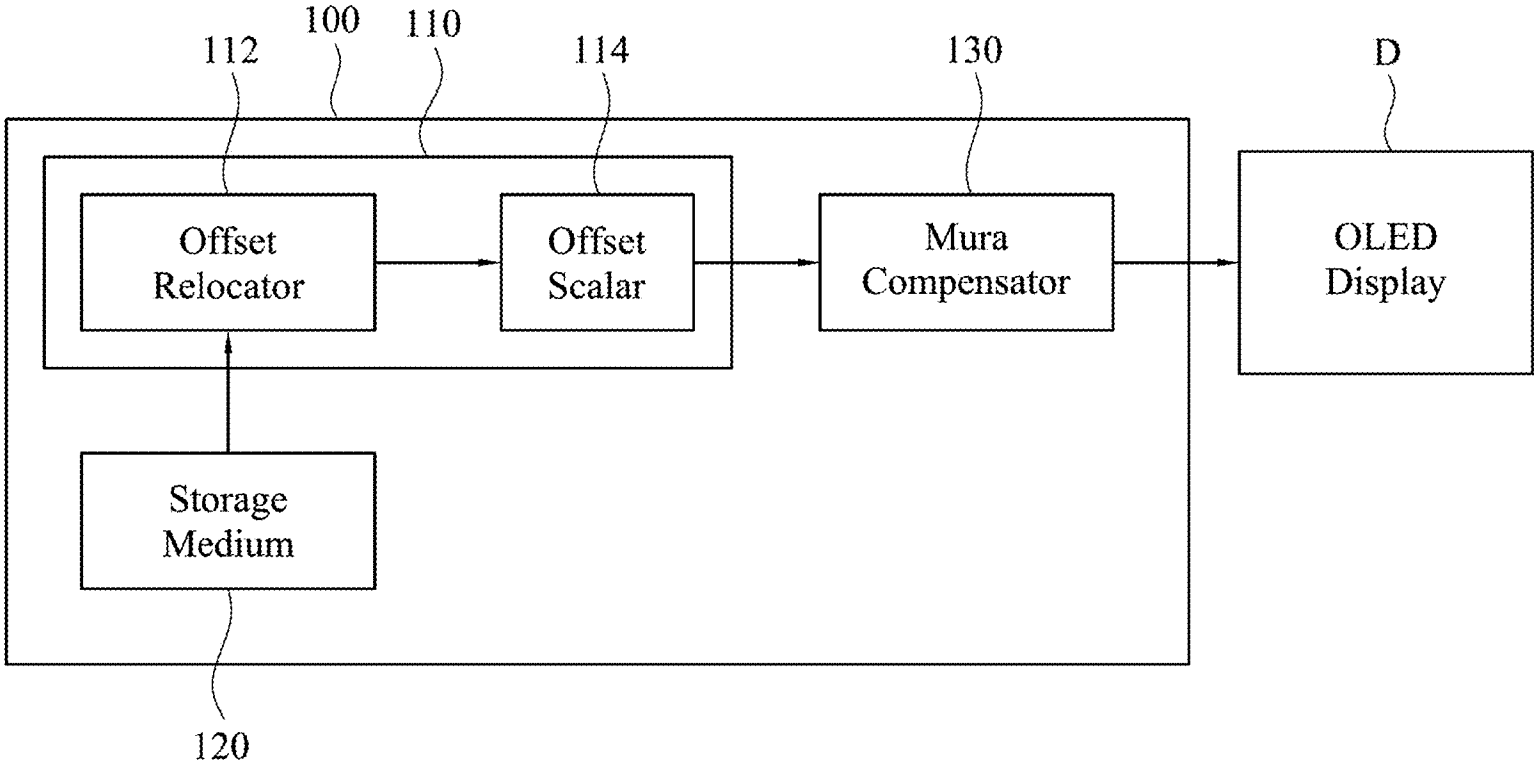
FIG. 1 illustrates a schematic diagram of a mura compensation apparatus in accordance with some embodiments of the invention.

The spirit of the disclosure is clearly described hereinafter accompanying with the drawings and detailed descriptions. After realizing preferred embodiments of the disclosure, any persons having ordinary skill in the art may make various modifications and changes according to the techniques taught in the disclosure without departing from the spirit and scope of the disclosure. Also, the described embodiments are presented for purposes of illustrations and description, and they are not intended to limit the scope of the invention.

Terms used herein are only used to describe the specific embodiments, which are not used to limit the claims appended herewith. Unless limited otherwise, the term "a," "an," "one" or "the" of the single form may also represent the plural form.

The document may repeat reference numerals and/or letters in the various examples. This repetition is for the purpose of simplicity and clarity and does not in itself dictate a relationship between the various embodiments and/or configurations discussed.

Referring to FIG. 1, which illustrates a schematic diagram of a mura compensation apparatus 100 in accordance with some embodiments of the invention. The mura compensation apparatus 100 may be utilized to compensate for mura phenomenon of an organic light emitting diode (OLED) display D or another similar display.

The mura compensation apparatus 100 includes a calculator 110, a storage medium 120 and a mura compensator 130. The calculator 110 may calculate a non-maximum-luminance demura offset value of the pixel of the OLED display D for a determined gray level on the basis of a maximum-luminance demura offset value of a pixel of the OLED display D for a relocated gray level and a non-maximum luminance value of the OLED display D. The maximum-luminance demura offset value is dependent on a position of the pixel in the OLED display D. That is, the maximum-luminance demura offset values respectively of variant pixels may be different. The storage medium 120 may store one or more demura tables corresponding to various gray levels for the maximum luminance value of the OLED display D. For example, the storage medium 120 may store two demura tables respectively corresponding to gray levels of 32 and 64. Each demura table stored in the storage medium 120 may include one or more maximum-luminance demura offset values of the pixels of the OLED display D for a particular gray level. The mura compensator 130 performs mura compensation on the pixels of the OLED display D by the non-maximum-luminance demura offset value for the determined gray level.

In particular, the calculator 110 includes an offset relocator 112 and an offset scalar 114. The offset relocator 112 calculates the relocated gray level gl' on the basis of the gamma value γ, the determined gray level gl, the non-maximum luminance value bl and the maximum luminance value $bl_{MAX}$ of the OLED display D by Equation (1):

$$gl' = gl \times \left(\frac{bl}{bl_{MAX}}\right)^{\frac{1}{\gamma}}, \tag{1}$$

and the offset scalar 114 performs a scalar operation on the maximum-luminance demura offset value $Ofs_M(gl')$ prestored in the storage medium 120 for the relocated gray level gl' by Equation (2) to obtain the non-maximum-luminance demura offset value Ofs(gl,bl) for the determined gray level gl and the non-maximum luminance value bl:

$$Ofs(gl, bl) = Ofs_M(gl') \times \left(\frac{bl}{bl_{MAX}}\right)^{\frac{1}{\gamma}}. \tag{2}$$

The mura compensator 130 then uses the obtained non-maximum-luminance demura offset value Ofs(gl,bl) to perform mura compensation for the OLED display D. It is noted that the non-maximum luminance value bl is smaller than the maximum luminance value $bl_{MAX}$. In other words, the non-maximum luminance value bl is a fraction of the maximum luminance value $bl_{MAX}$. In some embodiments, the non-maximum luminance value bl is a half of the maximum luminance value $bl_{MAX}$. In addition, the gamma value γ may be in a range from 1.8 to 2.4 depending on various design requirements of the OLED display D. In certain embodiments, the gamma value γ is 2.0 or 2.2.

The specific implementation of the calculator 110 mentioned above can be software and/or hardware. For hardware implementation, a processor capable of executing instructions may be utilized, such as a central processing unit (CPU), a microprocessor, or other hardware units. Oppositely, for software implementation, the calculator 110 may be placed in a schedule management tool in a non-transitory computer readable medium accessible by the processor, and can be executed by the processor. Also, the storage medium 120 may be the non-transitory computer readable medium or a part of the non-transitory computer readable medium. The non-transitory computer readable medium can be a read only memory, a flash memory, a floppy disk, a hard disk, a compact disc, an USB flash drive, a magnetic tape, a database capable of being accessed on the internet, or other computer readable media having the same functions that is obvious to those ordinary skill in the art.

Figure 2:
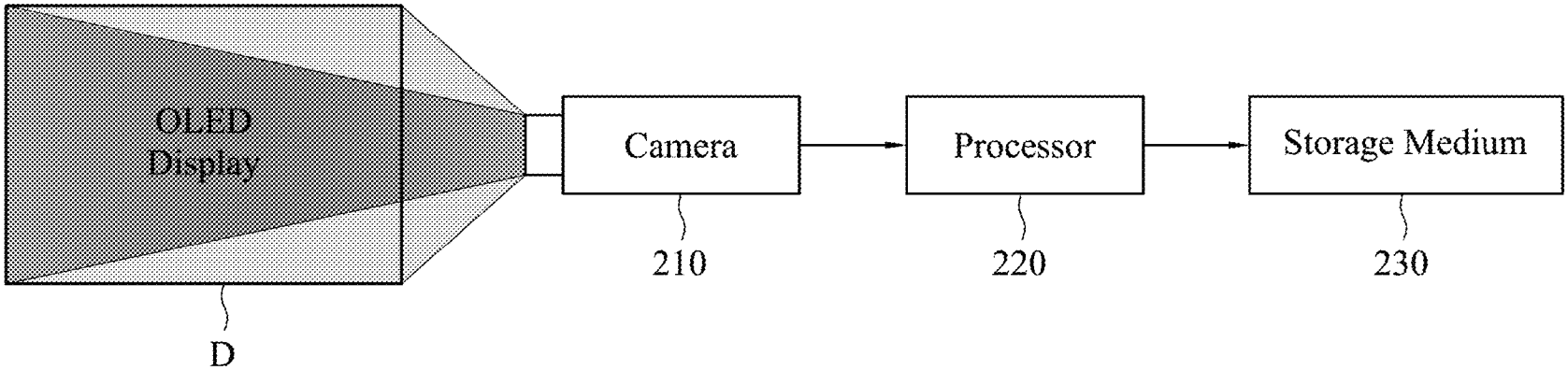
FIG. 2 exemplarily illustrates demura table creation for the maximum luminance value of an organic light emitting diode (OLED) display.

FIG. 2 exemplarily illustrates demura table creation for the maximum luminance value of the OLED display D. Firstly, a camera 210 is utilized to capture an image with a particular gray level of the OLED display D from the OLED display D operated in the maximum luminance value. Then, a processor 220 is used to receive the captured image from the camera 210 and create a demura table corresponding to the particular gray level for the maximum luminance value of the OLED display D from the captured image. After the demura table is created, the processor 220 stores the demura table in the storage medium 230. It is noted that the processor 220 may create plural demura tables respectively corresponding to various gray levels in a manner similar to the method described above. In certain examples, the processor 220 may create one or several demura tables respectively corresponding to one or several gray levels in a manner similar to the method described above, and then may create demura tables corresponding to the other gray levels by utilizing a transformation method such as linear scaling, interpolation and/or extrapolation on the basis of the created one or several demura tables.

The camera 210, the processor 220 and/or the storage medium 230 may be a part of the mura compensation apparatus 100 in FIG. 1. The storage medium 230 may be the same as the storage medium 120 in FIG. 1. Further, the processor 220 may be an image processor or another processing means suitable for image processing.

Figure 3:
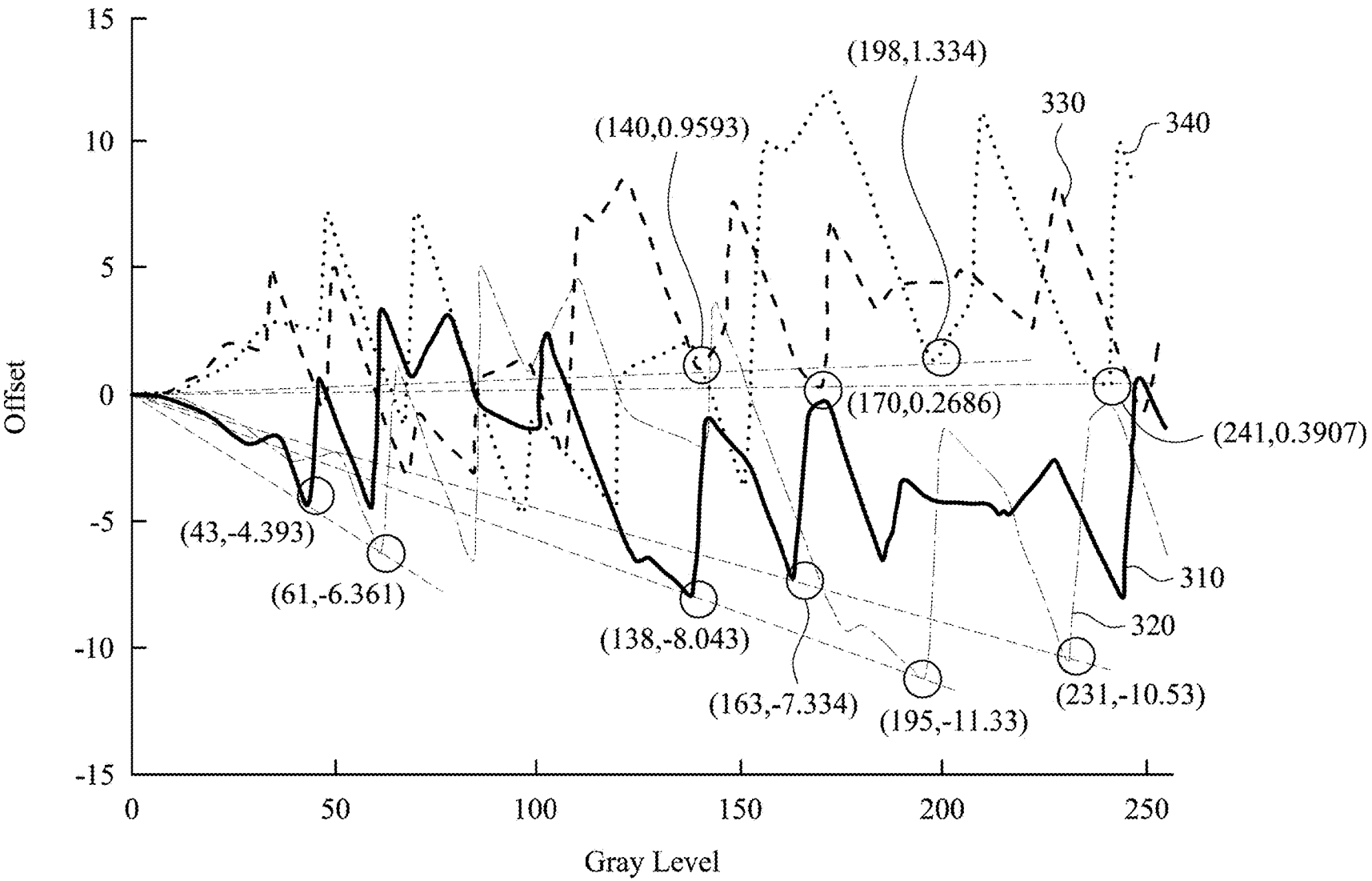
FIG. 3 shows the maximum-luminance demura offset values and the non-maximum-luminance demura offset values corresponding to various gray levels for two different pixels in an OLED display.

FIG. 3 shows the maximum-luminance demura offset values and the non-maximum-luminance demura offset values corresponding to various gray levels for two different pixels in the OLED display D. In FIG. 3, line graphs 310 and 320 respectively represent maximum-luminance demura offset values and non-maximum-luminance demura offset values for a pixel P1 in the OLED display D, while line graphs 330 and 340 respectively represent maximum-luminance demura offset values and non-maximum-luminance demura offset values for another pixel P2 in the OLED display D. The maximum-luminance demura offset values corresponding to gray levels 0-255 for pixels P1 and P2 in the OLED display D are known (e.g. stored in the storage medium 120/230), and the non-maximum-luminance demura offset values corresponding to gray levels 0-255 for pixels P1 and P2 are respectively derived from the maximum-luminance demura offset values by using Equations (1) and (2). As shown in FIG. 3, for each of the pixels P1 and P2, the line graph of non-maximum-luminance demura offset values is a scaled version of the maximum-luminance demura offset values by the scale factor $$\left(\frac{bl}{bl_{MAX}}\right)^{\frac{1}{\gamma}}.$$

In FIG. 3, the non-maximum luminance value bl is a half of the maximum luminance value $bl_{MAX}$, and the gamma value γ is 2.2. For example, the maximum-luminance demura offset values for the pixel P1 respectively corresponding to the relocated gray levels 43, 138, 163 are −4.393, −8.043, −7.334, and after the calculation by the calculator 110, the non-maximum-luminance demura offset values for the pixel P1 respectively corresponding to the determined gray levels 61, 195, 231 are −6.361, −11.33, −10.53; the maximum-luminance demura offset values for the pixel P2 respectively corresponding to the relocated gray levels 140, 170 are 0.9593, 0.2686, and after the calculation by the calculator 110, the non-maximum-luminance demura offset values for the pixel P2 respectively corresponding to the determined gray levels 198, 241 are 1.334, 0.3907.

Figure 4:
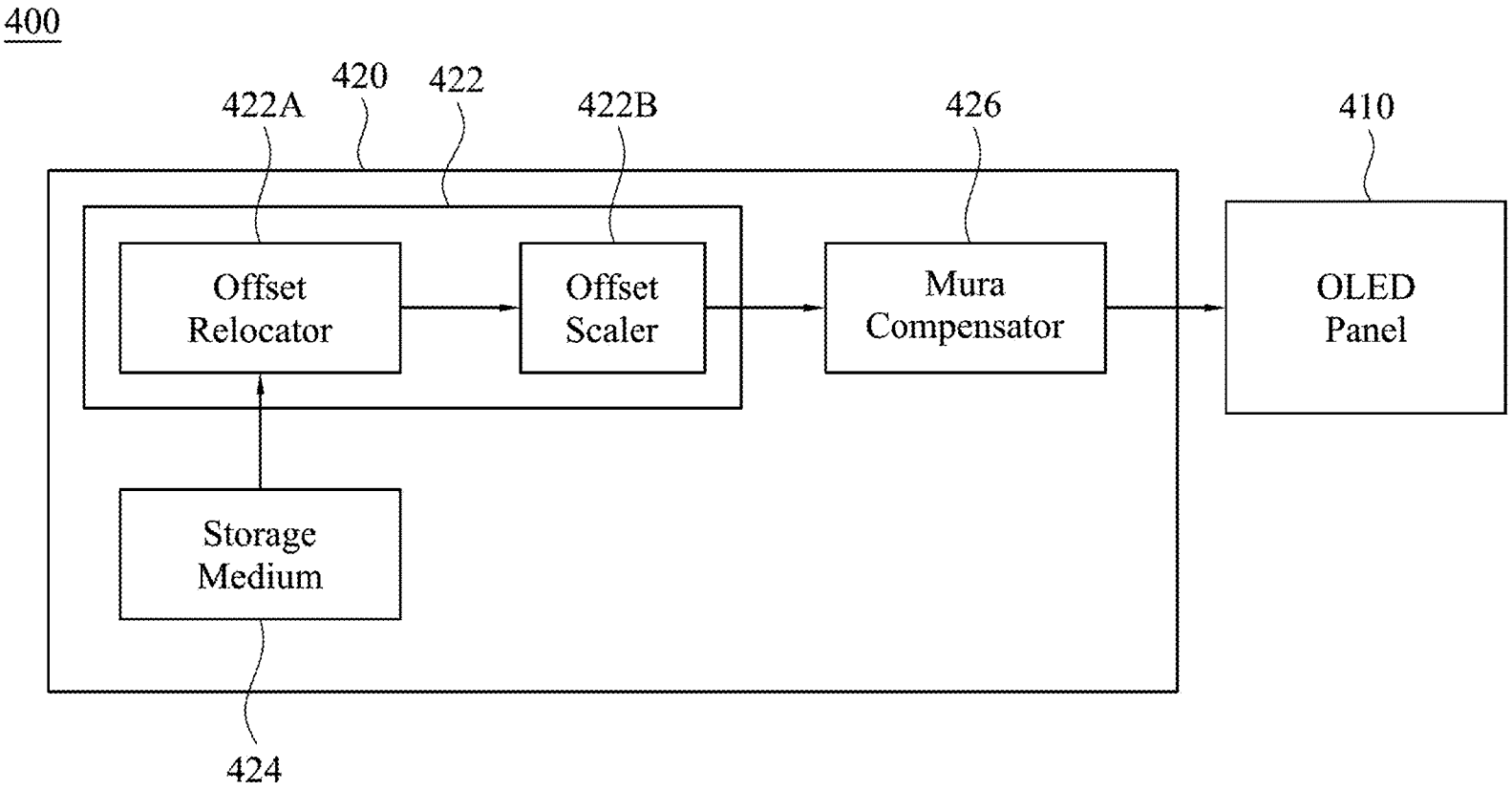
FIG. 4 illustrates an electronic device in accordance with some embodiments of the invention.

FIG. 4 illustrates an electronic device 400 in accordance with some embodiments of the invention. The electronic device 400 may be, for example, a smartphone, a tablet, a notebook or another similar device that has an OLED panel for display. The electronic device 400 includes an OLED panel 410 and a mura compensation apparatus 420. The OLED panel 410 is used to display images according to image data from, for example, a graphic processing unit (GPU). The OLED panel 410 may include any suitable type of pixels each having a data transistor, a driving transistor, a storage capacitor and an organic photodiode. The mura compensation apparatus 420 is utilized to compensate for mura phenomenon of the OLED panel 410. The mura compensation apparatus 420 includes a calculator 422, a storage medium 424 and a mura compensator 426. In particular, the calculator 422 includes an offset relocator 422A and an offset scalar 422B. The offset relocator 422A, the offset scalar 422B, the storage medium 424 and the mura compensator 426 may be similar to the offset relocator 112, the offset scalar 114, the storage medium 120 and the mura compensator 130 shown in FIG. 1, and therefore the related description thereof can be referred to the foregoing paragraphs and is not repeated herein.

According to the embodiments described above, a pre-created maximum-luminance demura table can be used for mura compensation for various luminance settings of an OLED display. That is, for mura compensation of an OLED display, non-maximum-luminance demura offset values corresponding to a non-maximum luminance value of the OLED display can be determined from maximum-luminance demura offset values corresponding to the maximum luminance value of the OLED display, and thus a non-maximum-luminance demura table with these non-maximum-luminance demura offset values is not required to be created and stored in a storage medium. As such, the demura table cost for mura compensation for various luminance settings is significantly reduced.

It will be apparent to those skilled in the art that various modifications and variations can be made to the structure of the invention without departing from the scope or spirit of the invention. In view of the foregoing, it is intended that the invention cover modifications and variations of this invention provided they fall within the scope of the following claims.

What is claimed is:

1. A mura compensation apparatus for an organic light emitting diode (OLED) display, the mura compensation apparatus comprising:

a calculator configured to calculate a non-maximum-luminance demura offset value of a pixel of the OLED display corresponding to a predetermined gray level, the calculator comprising:

an offset relocator configured to calculate a relocated gray level by the following equation:

$$gl' = gl \times \left(\frac{bl}{bl_{MAX}}\right)^{\frac{1}{\gamma}},$$

where gl', γ, gl, bl and $bl_{MAX}$ are respectively the relocated gray level, a gamma value, a predetermined gray level, a non-maximum luminance value and a maximum luminance value of the OLED display; and an offset scalar configured to perform a scalar operation to obtain the non-maximum-luminance demura offset value corresponding to the predetermined gray level by the following equation:

$$Ofs(gl, bl) = Ofs_M(gl') \times \left(\frac{bl}{bl_{MAX}}\right)^{\frac{1}{\gamma}},$$

where Ofs(gl,bl) is the non-maximum-luminance demura offset value corresponding to the predetermined gray level, and $Ofs_M(gl')$ is a maximum-luminance demura offset value of the pixel of the OLED display corresponding to the relocated gray level; and a mura compensator configured to perform mura compensation on the pixel of the OLED display by the non-maximum-luminance demura offset value corresponding to the predetermined gray level.

2. The mura compensation apparatus of claim 1, wherein the gamma value is in a range from 1.8 to 2.4.

3. The mura compensation apparatus of claim 1, further comprising:

a camera configured to capture an image of the OLED display operated in the maximum luminance value; and a processor configured to create a demura table with the maximum-luminance demura offset value corresponding to the predetermined gray level from the captured image.

4. The mura compensation apparatus of claim 1, wherein the non-maximum luminance value is substantially a half of the maximum luminance value of the OLED display.

5. The mura compensation apparatus of claim 1, further comprising:

a storage medium configured to store a demura table with the maximum-luminance demura offset value corresponding to the predetermined gray level.

6. The mura compensation apparatus of claim 1, wherein the maximum-luminance demura offset value is dependent on a position of the pixel in the OLED display.

7. A mura compensation method for an organic light emitting diode (OLED) display, the mura compensation method comprising:

calculating a relocated gray level by the following equation:

$$gl' = gl \times \left(\frac{bl}{bl_{MAX}}\right)^{\frac{1}{\gamma}},$$

where gl', γ, gl, bl and $bl_{MAX}$ are respectively the relocated gray level, a gamma value, a predetermined gray level, a non-maximum luminance value and a maximum luminance value of the OLED display; and performing a scalar operation to obtain a non-maximum-luminance demura offset value of a pixel of the OLED display corresponding to the predetermined gray level by the following equation:

$$Ofs(gl, bl) = Ofs_M(gl') \times \left(\frac{bl}{bl_{MAX}}\right)^{\frac{1}{\gamma}},$$

where Ofs(gl,bl) is the non-maximum-luminance demura offset value corresponding to the predetermined gray level, and $Ofs_M(gl')$ is a maximum-luminance demura offset value of the pixel of the OLED display corresponding to the relocated gray level; and performing mura compensation on the pixel of the OLED display by the non-maximum-luminance demura offset value corresponding to the predetermined gray level.

8. The mura compensation method of claim 7, wherein the gamma value is in a range from 1.8 to 2.4.

9. The mura compensation method of claim 7, further comprising:

capturing an image of the OLED display operated in Hall the maximum luminance value; and creating a demura table with the maximum-luminance demura offset value corresponding to the predetermined gray level from the captured image.

10. The mura compensation method of claim 7, wherein the non-maximum luminance value is substantially a half of the maximum luminance value of the OLED display.

11. The mura compensation method of claim 7, wherein the maximum-luminance demura offset value is dependent on a position of the pixel in the OLED display.

12. An electronic device, comprising:

an organic light emitting diode (OLED) panel; and a mura compensation apparatus comprising:

a calculator configured to calculate a non-maximum-luminance demura offset value of a pixel of the OLED panel corresponding to a predetermined gray level, the calculator comprising:

an offset relocator configured to calculate a relocated gray level by the following equation:

$$gl' = gl \times \left(\frac{bl}{bl_{MAX}}\right)^{\frac{1}{\gamma}},$$

where gl', γ, gl, bl and $bl_{MAX}$ are respectively the relocated gray level, a gamma value, a predetermined gray level, a non-maximum luminance value and a maximum luminance value of the OLED display; and an offset scalar configured to perform a scalar operation to obtain the non-maximum-luminance demura offset value corresponding to the predetermined gray level by the following equation:

$$Ofs(gl, bl) = Ofs_M(gl') \times \left(\frac{bl}{bl_{MAX}}\right)^{\frac{1}{\gamma}},$$

where Ofs(gl,bl) is the non-maximum-luminance demura offset value corresponding to the predetermined gray level, and $Ofs_M(gl')$ is a maximum-luminance demura offset value of the pixel of the OLED display corresponding to the relocated gray level; and a mura compensator configured to perform mura compensation on the OLED panel by the non-maximum-luminance demura offset value corresponding to the predetermined gray level.

13. The electronic device of claim 12, wherein the gamma value is in a range from 1.8 to 2.4.

14. The electronic device of claim 12, wherein the non-maximum luminance value is substantially a half of the maximum luminance value of the OLED panel.

15. The electronic device of claim 12, further comprising:

a storage medium configured to store a demura table with the maximum-luminance demura offset value corresponding to the predetermined gray level.

16. The electronic device of claim 12, wherein the maximum-luminance demura offset value is dependent on a position of the pixel in the OLED panel.

17. The electronic device of claim 12, wherein the mura compensation apparatus communicates with the OLED panel through a display serial interface (DSI).

* * * * *